US009976572B2

(12) United States Patent
Kogame

(10) Patent No.: US 9,976,572 B2
(45) Date of Patent: May 22, 2018

(54) VACUUM PUMP PROTECTION NET, METHOD FOR MANUFACTURING THE SAME, AND VACUUM PUMP

(71) Applicant: KO-GAME, Masahito (JP)

(72) Inventor: Masahito Kogame, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 460 days.

(21) Appl. No.: 14/417,972

(22) PCT Filed: Sep. 26, 2012

(86) PCT No.: PCT/JP2012/074728

§ 371 (c)(1),
(2) Date: Jan. 28, 2015

(87) PCT Pub. No.: WO2014/049728

PCT Pub. Date: Apr. 3, 2014

(65) Prior Publication Data

US 2015/0204353 A1 Jul. 23, 2015

(51) Int. Cl.

| | |
|---|---|
| ***F04D 29/70*** | (2006.01) |
| ***F04B 37/14*** | (2006.01) |
| ***F04B 37/16*** | (2006.01) |
| ***F04B 39/16*** | (2006.01) |
| ***F04D 19/04*** | (2006.01) |

(Continued)

(52) U.S. Cl.

CPC ..... *F04D 29/701* (2013.01); *F04B 37/14* (2013.01); *F04B 37/16* (2013.01); *F04B 39/16* (2013.01);

(Continued)

(58) Field of Classification Search

None

See application file for complete search history.

(56) References Cited

U.S. PATENT DOCUMENTS 7,442,303 B2 * 10/2008 Jacobson ..... B01D 63/16 210/500.22
2006/0127690 A1 6/2006 Ueda et al.

(Continued)

FOREIGN PATENT DOCUMENTS

EP 2644899 A1 * 10/2013 ..... F04B 37/02
JP 4-116694 10/1992

(Continued)

OTHER PUBLICATIONS

JP 2009209827—translation (retrieved Apr. 2, 2017).*

(Continued)

*Primary Examiner* — Jessica Cahill
*Assistant Examiner* — Daphne M Barry
(74) *Attorney, Agent, or Firm* — Renner, Otto, Boisselle & Sklar, LLP

(57) ABSTRACT

A vacuum pump protection net 50 is provided with a peripheral edge section 51 and a flat mesh section 52 which is formed on the inner side of the peripheral edge section 51 and has a plurality of through holes 55. The thickness of the mesh section 52 is equal to or less than half the thickness of the peripheral edge section 51. A first surface of the mesh section 52 is located on the same plane as a first surface of the peripheral edge section 52. A second surface of the mesh section 52 is recessed from a second surface of the peripheral edge section 51.

3 Claims, 10 Drawing Sheets

(51) Int. Cl.
*F04D 29/62* (2006.01)
*F04D 29/64* (2006.01)

(52) U.S. Cl.
CPC ..... *F04D 19/04* (2013.01); *F04D 19/042* (2013.01); *F04D 29/624* (2013.01); *F04D 29/644* (2013.01); *Y10T 29/49236* (2015.01)

(56) References Cited

U.S. PATENT DOCUMENTS

| | | | |
|---|---|---|---|
| 2013/0153488 | A1 | 6/2013 | Hori et al. |
| 2013/0230384 | A1 | 9/2013 | Okudera et al. |

FOREIGN PATENT DOCUMENTS

| | | | | | |
|---|---|---|---|---|---|
| JP | 11-247790 | | | 9/1999 | |
| JP | 2009-209827 | | | 9/2009 | |
| JP | 2009209827 | A | * | 9/2009 | ..... F04D 19/042 |
| JP | 4892621 | | | 3/2012 | |
| WO | WO 2004/065660 | | | 8/2004 | |
| WO | WO 2010/064321 | A1 | | 6/2010 | |
| WO | WO 2012/029431 | A1 | | 3/2012 | |
| WO | WO 2012/070282 | A1 | | 5/2012 | |

OTHER PUBLICATIONS

Notice of Reasons for Rejection for corresponding Japanese Application No. 2014-537907 dated Mar. 29, 2016 (English translation).
Japanese Office Action for corresponding Japanese Application No. 2014-537907 dated Sep. 1, 2015 (with English translation).
International Search Report for corresponding International Application No. PCT/JP2012/074728 dated Dec. 18, 2012.
Office Action for corresponding Japan Patent Application No. 2014-537907, dated Jul. 25, 2017 (English translation).

* cited by examiner (A)

(B)

VACUUM PUMP PROTECTION NET, METHOD FOR MANUFACTURING THE SAME, AND VACUUM PUMP

TECHNICAL FIELD

The present invention relates to a vacuum pump protection net, a method for manufacturing the vacuum pump protection net, and a vacuum pump.

BACKGROUND ART

A vacuum pump such as a turbo-molecular pump includes an exhaust structure unit which is attached inside a case member, and sucks gas inside a vacuum processing chamber of an external apparatus, for example, a semiconductor manufacturing apparatus through a suction opening and discharges the gas through an exhaust opening by the exhaust structure unit. Generally, a protection net having many minute through holes is disposed on the suction opening of the vacuum pump. The protection net prevents a foreign substance flying from the vacuum processing chamber from entering the inside of the vacuum pump and colliding with members of the exhaust structure unit such as a rotor body. The protection net is deformed to be twisted when the vacuum pump enters the atmosphere and swells toward the exhaust structure unit.

If the deformed part of the protection net abuts on the rotor body of the exhaust structure unit, the protection net itself and the rotor body are damaged. Thus, it is necessary to prevent abutment between the protection net and the rotor body. However, largely separating the protection net from the rotor body increases the size of the vacuum pump. As a structure that prevents abutment between the protection net and the rotor body without increasing the size of the vacuum pump, there has been known a structure that changes the height of the protection net stepwise from a peripheral edge section toward the center thereof. Increasing the height of the center of the protection net toward the vacuum processing chamber so as to be away from the rotor body makes it possible to prevent contact with the rotor body even when the protection net is deformed (refer to Patent Document 1, for example).

PRIOR ART DOCUMENT

Patent Document

Patent Document 1: JP 2009-209827 A

SUMMARY OF THE INVENTION

Problems to be Solved by the Invention

The protection net descried in the above patent document is formed in a stepwise shape, which increases the thickness of the protection net. Thus, disadvantageously, the size of the vacuum pump increases, and the suction resistance in a net region also increases.

Solutions to the Problems

A vacuum pump protection net according to a first embodiment of the present invention comprises: a peripheral edge section; and a mesh section integrally formed with the peripheral edge section using the same material on an inner side of the peripheral edge section, the mesh section being entirely flat and where a plurality of through holes penetrating the mesh section in a thickness direction are formed. A thickness of the mesh section is equal to or less than half a thickness of the peripheral edge section, a first surface of the mesh section is located on the same plane as a first surface of the peripheral edge section, and a second surface of the mesh section is recessed from a second surface of the peripheral edge section.

Preferably the vacuum pump protection net according to a second embodiment of the present invention further comprises a reinforcement rib integrally formed with the peripheral edge section and the mesh section using the same material. A first surface of the reinforcement rib is located on the same plane as the first surface of the peripheral edge section, and a second surface of the reinforcement rib is located on the same plane as the second surface of the peripheral edge section.

Preferably in the vacuum pump protection net according to a third embodiment of the present invention, a side surface of the reinforcement rib is located on the same plane as any of side edges of the through holes adjacent to the reinforcement rib.

Preferably in the vacuum pump protection net according to a fourth embodiment of the present invention, the reinforcement rib extends along the side edges of the through holes and has a wide portion and a narrow portion.

A method for manufacturing a vacuum pump protection net according to a fifth embodiment of the present invention, the vacuum pump protection net comprising a peripheral edge section and a mesh section integrally formed with the peripheral edge section on an inner side of the peripheral edge section, the mesh section having a thickness equal to or less than half a thickness of the peripheral edge section and where a plurality of through holes are formed, the method comprises the steps of: forming a plurality of the through holes by etching on a first surface of a plate-like member; forming a recess on the inner side of the peripheral edge section by etching on a second surface of the plate-like member; and forming a portion that is not etched by each of the etchings as the peripheral edge section.

Preferably the manufacturing method according to a sixth embodiment of the present invention further comprises the steps of: applying photoresists to both the first and second surfaces of the plate-like member; arranging a mask on the first surface of the plate-like member, the mask having the same outer periphery as an outer periphery of the peripheral edge section and having openings corresponding to the through holes; arranging a mask on the second surface of the plate-like member, the mask having the same outer periphery as the outer periphery of the peripheral edge section and having an opening corresponding to the entire mesh section; and developing the photoresists.

Preferably the manufacturing method according to a seventh embodiment of the present invention further comprises the steps of: applying photoresists to both the first and second surfaces of the plate-like member; arranging a mask on the first surface of the plate-like member, the mask having the same outer periphery as the outer periphery of the peripheral edge section, having openings corresponding to the through holes, and having a mask section corresponding to a reinforcement rib; arranging a mask on the second surface of the plate-like member, the mask having the same outer periphery as the outer periphery of the peripheral edge section, having an opening corresponding to the entire mesh section, and having a mask section corresponding to the reinforcement rib; and developing the photoresists. A portion that is not etched by each of the etchings is formed as the peripheral edge section and the reinforcement rib.

A vacuum pump according to a eighth embodiment of the present invention comprises: a pump container having a suction opening which sucks gas therethrough from an external apparatus and an exhaust opening which discharges the gas therethrough; an exhaust structure section provided between the suction opening and the exhaust opening inside the pump container; and the protection net according to any one of the embodiments 1 to 4 disposed on the suction opening of the vacuum pump.

Effects of the Invention

According to the present invention, the thickness of a mesh section of the vacuum pump protection net is equal to or less than half the thickness of the peripheral edge section. Therefore, it is possible to ensure the attachment strength in the peripheral edge section and also reduce the suction resistance in the mesh section without increasing the size of the vacuum pump.

BRIEF DESCRIPTION OF THE DRAWINGS

FIGS. 6(A) and 6(B) are diagrams for illustrating a vacuum pump protection net according to a second embodiment of the present invention, wherein FIG. 6(A) is a plan view and FIG. 6(B) is a cross-sectional view taken along line VIB-VIB in FIG. 6(A).

EMBODIMENTS OF THE INVENTION

First Embodiment (Vacuum Pump)

Figure 1:
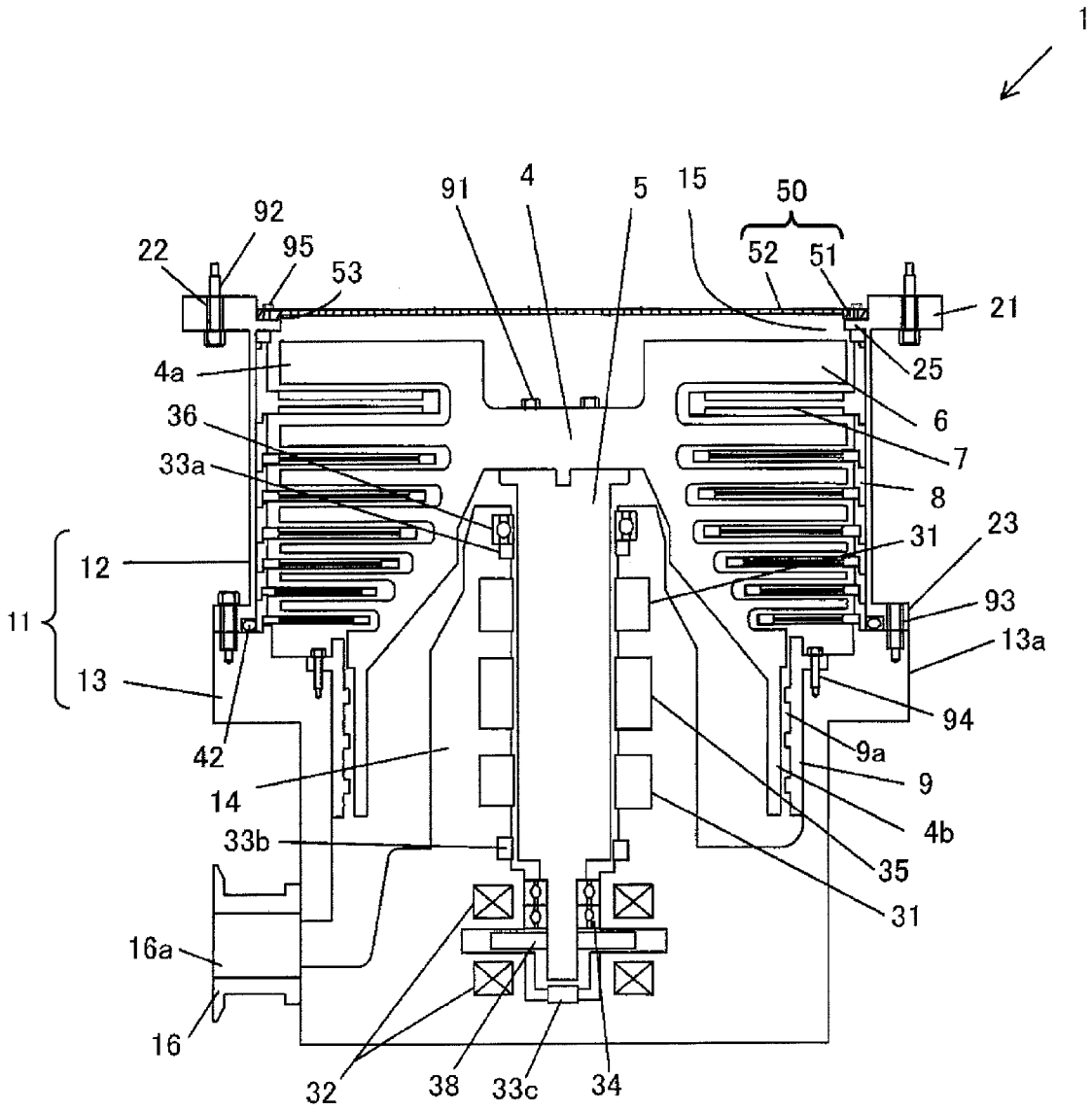
FIG. 1 is a cross-sectional view of a turbo-molecular pump as an embodiment of a vacuum pump according to the present invention.
Figure 2:
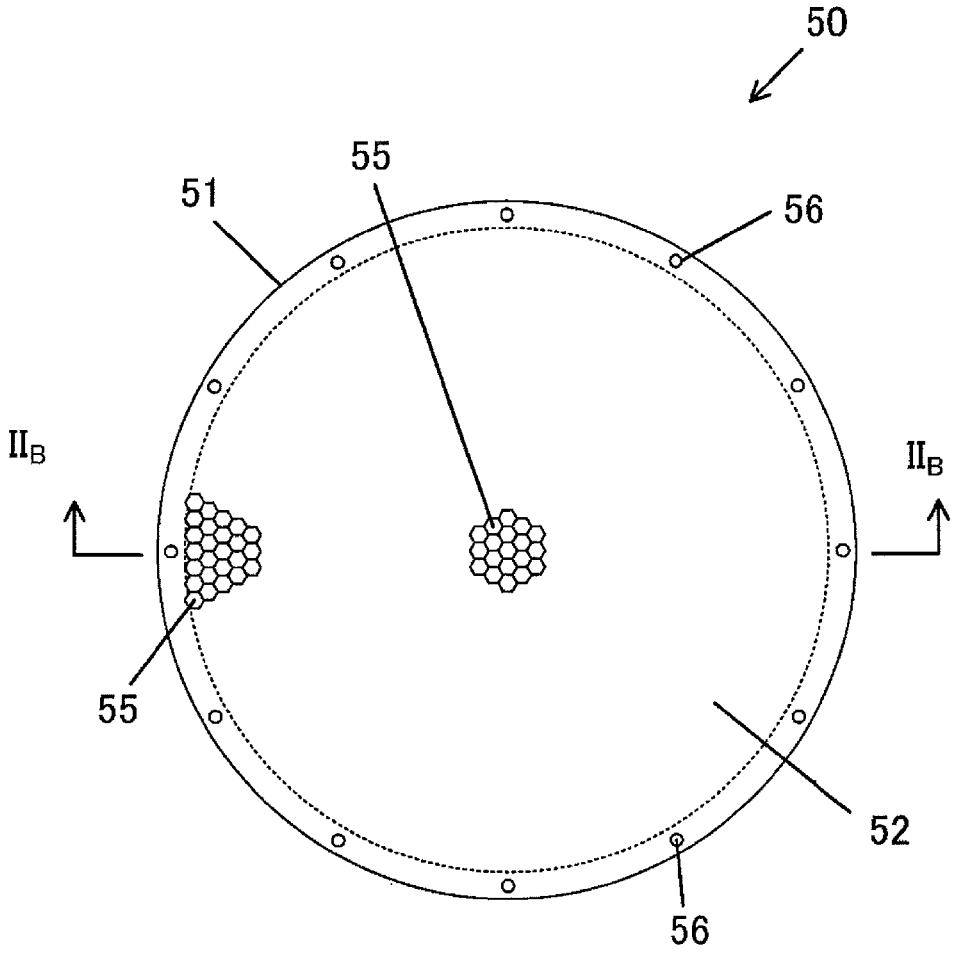
FIGS. 2(*a*) and 2(*b*) are explanatory diagrams of a vacuum pump protection net according to the present invention, wherein FIG. 2(*a*) is a plan view and FIG. 2(*b*) is a cross-sectional view taken along line IIB-IIB in FIG. 2(*a*).
Figure 2:
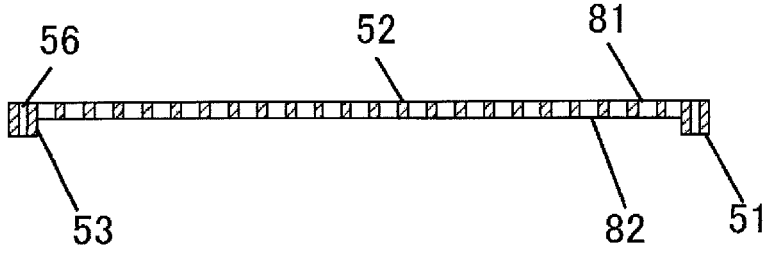
Figure 3:
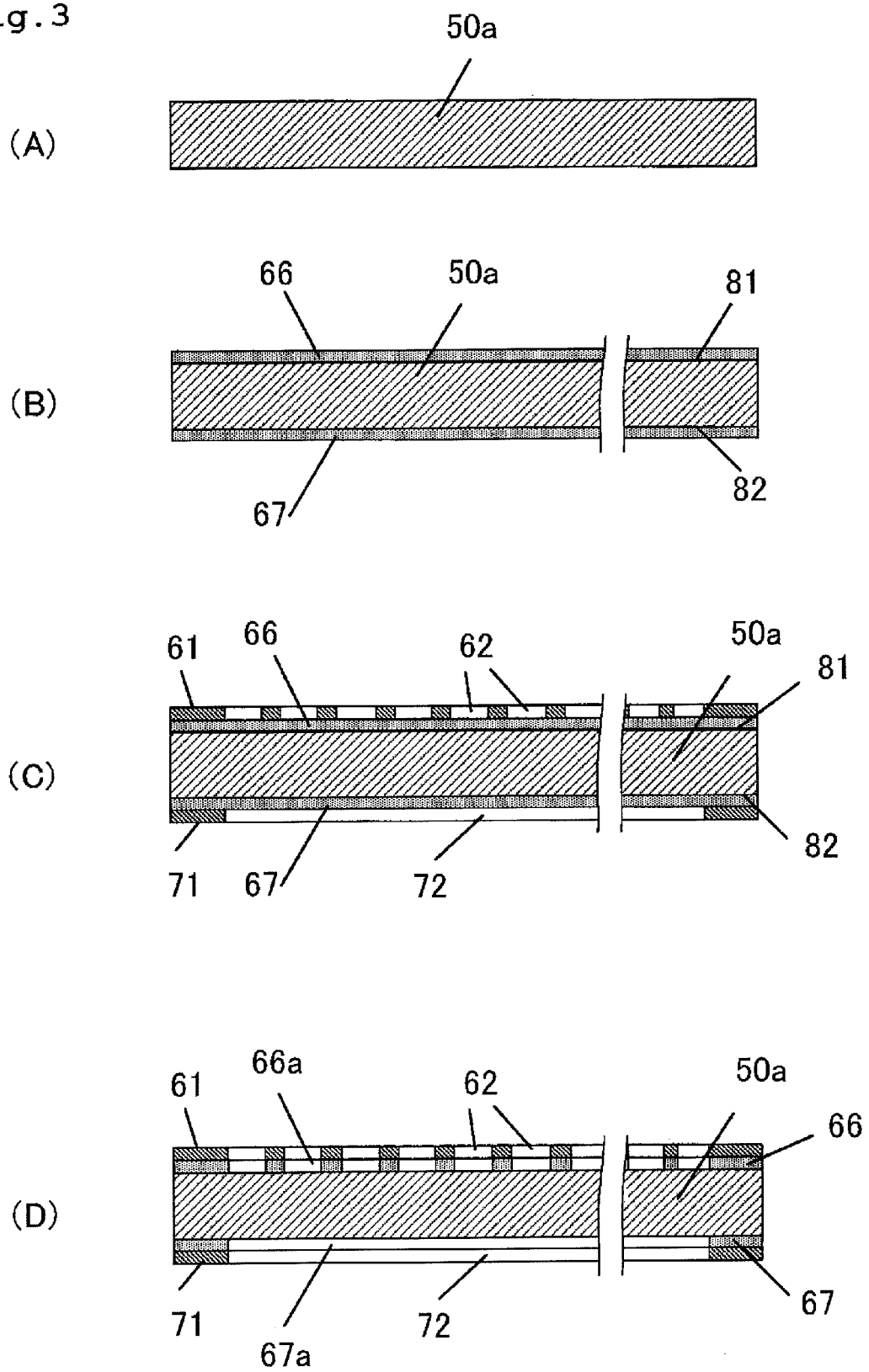
FIGS. 3(A) to 3(D) are diagrams for illustrating an embodiment of a method for manufacturing the vacuum pump protection net.
Figure 4:
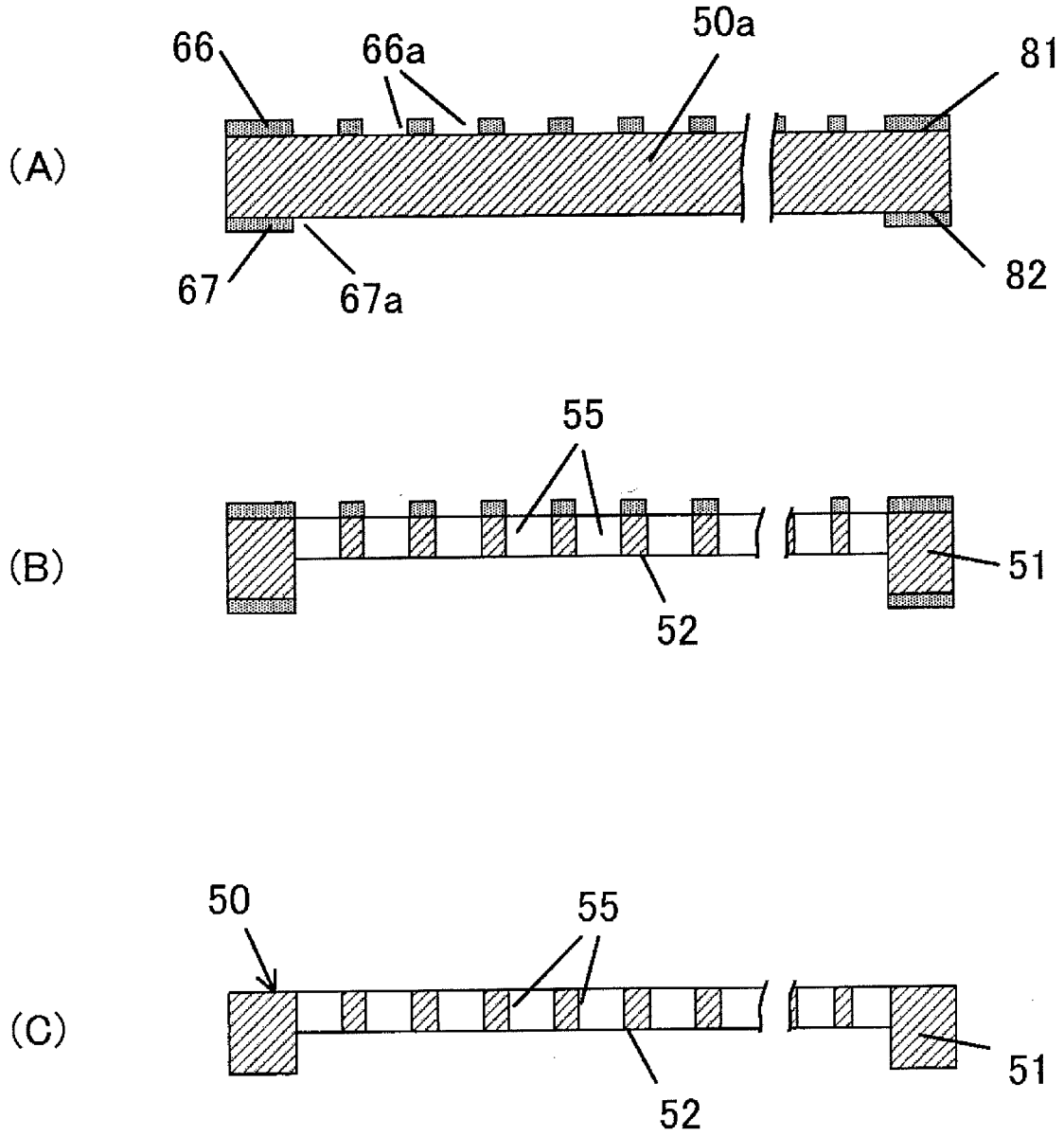
FIGS. 4(A) to 4(C) are diagrams for illustrating steps following the steps of FIGS. 3(A) to 3(D).

Hereinbelow, an embodiment of a vacuum pump protection net and a vacuum pump of the present invention will be described with reference to FIGS. 1 to 4(C). FIG. 1 is a cross-sectional view of a turbo-molecular pump as an embodiment of the vacuum pump of the present invention. The turbo-molecular pump 1 is provided with a pump container 11 which includes a case member 12 and a base 13 fixed to the case member 12. The case member 12 has a generally cylindrical shape. The case member 12 is formed of, for example, SUS. An upper flange 21 is formed on an upper end of the case member 12. A circular suction opening 15 is formed on the inner side of the upper flange 21 of the case member 12. The upper flange 21 has bolt insertion through holes 22 which are formed at substantially equal intervals along a circumferential direction. The turbo-molecular pump 1 is attached to an external apparatus, for example, a semiconductor manufacturing apparatus with bolts 92 inserted through the through holes 22 of the upper flange 21.

A rotor 4 and a rotor shaft 5 which is coaxially attached to the rotor 4 are housed inside the pump container 11. The rotor 4 is formed of an aluminum alloy. The rotor 4 and the rotor shaft 5 are fixed to each other with bolts 91.

The rotor 4 has a two-stage structure including an upper rotor moving blade section 4*a* and a lower rotor cylindrical section 4*b*. A plurality of stages of rotor blades 6 are formed at intervals in a vertical direction on the rotor moving blades section 4*a*. A plurality of stator blades 7 are arranged between the respective stages of the rotor blades 6. Each of the stator blades 7 has a ring-like shape formed by combining a pair of half rings. Ring-like spacers 8 which sandwich the stator blades 7 are arranged on the outer peripheries of the stator blades 7 along the inner peripheral surface of the case member 12. The rotor blades 6 and the stator blades 7 are alternately stacked in multiple stages to construct an exhaust structure unit for high vacuum.

A ring-like screw stator 9 is fixed to the base 13 with bolts 94 at the outer peripheral side of the rotor cylindrical section 4*b*. A screw groove section 9*a* is formed on the screw stator 9. The rotor cylindrical section 4*b* of the rotor 4 and the screw stator 9 together constitute a screw groove exhaust unit for low vacuum. In FIG. 1, the structure in which the screw groove section 9*a* is formed on the screw stator 9 has been illustrated as an example. However, the screw groove section 9*a* may be formed on the outer peripheral surface of the rotor cylindrical section 4*b*.

The base 13 is formed of, for example, an aluminum alloy. A central cylindrical section 14 having a circular hollow section into which the rotor shaft 5 is inserted is formed on the central part of the base 13. A motor 35, two radial magnetic bearings 31, a pair of upper and lower thrust magnetic bearings 32, radial displacement sensors 33*a*, 33*b*, an axial displacement sensor 33*c*, mechanical bearings 34, 36, and a rotor disk 38 are attached inside the central cylindrical section 14.

The rotor shaft 5 is supported in a contactless manner by the two radial magnetic bearings 31 and the pair of upper and lower thrust magnetic bearings 32. The position of the rotor shaft 5 during rotation is controlled based on a radial-direction position detected by the radial displacement sensors 33*a*, 33*b* and an axial-direction position detected by the axial displacement sensor 33*c*. The rotor shaft 5 which is magnetically levitated in a rotatable manner by the magnetic bearings 31, 32 is driven to rotate at high speed by the motor 35. The mechanical bearings 34, 36 are emergency mechanical bearings and support the rotor shaft 5 when the magnetic bearings 31, 32 are not operating.

An exhaust port 16 is disposed on the base 13. An exhaust opening 16*a* is formed on the exhaust port 16. A lower flange 23 of the case member 12 and an upper flange 13*a* of the base 13 are fixed to each other with bolts 93 with a seal member 42 interposed therebetween to construct the pump container 11.

A protection net 50 is disposed to cover the suction opening 15 formed on the inner side of the upper flange 21 of the case member 12. The protection net 50 is fastened to a step 25 formed on the inner side of the upper flange 21 with bolts 95.

The protection net 50 is arranged with a predetermined distance in the axial direction of the rotor shaft 5 from the highest rotor blade 6 of the rotor 4. As will be described below with reference to FIGS. 2(A) and 2(B), the protection net 50 includes a peripheral edge section 51 and a net section (herein below, referred to as "mesh section 52") having a thickness thinner than the thickness of the peripheral edge section 51. One side of the mesh section 52, the side facing the rotor blades 6, is recessed from the peripheral edge section 51, and the opposite side thereof is located on the same plane as the peripheral edge section 51. A boundary 53 between the mesh section 52 and the peripheral edge section 51 is located on substantially the same plane as an inner peripheral edge of the step 25 formed on the inner side of the upper flange 21. That is, substantially the entire surface of the mesh section 52 is arranged corresponding to the suction opening 15. Thus, the protection net 50 is disposed without disturbing the flow of gas sucked from a vacuum processing chamber of the external apparatus.

The rotation of the rotor blades 6 brings the exhaust structure unit into a high vacuum state. Accordingly, gas inside the vacuum processing chamber of the external apparatus is sucked into the exhaust structure unit through the mesh section 52 of the protection net 50 which is disposed on the suction opening 15. The gas that has been sucked into the exhaust structure section is discharged from the exhaust opening 16*a* of the exhaust port 16 through the screw groove exhaust unit by the rotation of the rotor cylindrical section 4*b*. Next, the protection net 50 will be described.

(Protection Net)

FIGS. 2(A) and 2(B) are diagrams of the vacuum pump protection net according to the present invention, wherein FIG. 2(A) is a plan view and the FIG. 2(B) is a cross-sectional view taken along line IIB-IIB in FIG. 2(A). The protection net 50 has a generally discoid shape, and includes the peripheral edge section 51 and the mesh section 52 formed on the inner side of the peripheral edge section 51 as described above. The peripheral edge section 51 and the mesh section 52 are integrally formed of, for example, a SUS material. The thickness of the peripheral edge section 51 is, for example, approximately 500 μm. The thickness of the mesh section 52 is, for example, approximately 250 μm, that is, approximately half the thickness of the peripheral edge section 51.

On one surface 81 (hereinbelow, referred to as "first surface 81") of the protection net 50, the peripheral edge section 51 and the mesh section 52 are located on the same plane, and the entire mesh section 52 is substantially flat. On the other surface 82 (hereinbelow, referred to as "second surface 82") of the protection net 50, the mesh section 52 is formed in a recessed shape recessed from the peripheral edge section 51. A plurality of through holes 56 are formed on the peripheral edge section 51, the through holes 56 penetrating the peripheral edge section 51 in the thickness direction. As described above, the bolts 95 are inserted into the respective through holes 56 so that the protection net 50 is fixed to the step 25 of the upper flange 21 of the case member 12. That is, the through holes 56 of the peripheral edge section 51 serve as an attachment section of the protection net 50.

Many through holes 55 are formed on the mesh section 52. In FIG. 2(A), the through holes 55 of the mesh section 52 are illustrated only in a partial region for the convenience of illustration. The through holes 55 are continuously formed throughout the entire mesh section 52. The mesh section 52 has a honeycomb structure. Specifically, each of the through holes 55 of the mesh section 52 is formed in regular hexagon. The through holes 55 are required to have a function of blocking or reflecting a foreign substance flying from the vacuum processing chamber. However, at the same time, it is necessary to reduce suction resistance against gas passing through the mesh section 52 in order to prevent the performance of the vacuum pump from being deteriorated. The honeycomb structure makes the circumference of the through holes 55 shortest. Thus, the honeycomb structure ensures the strength of the mesh section 52 and also increases the area of the through holes 55 to reduce the suction resistance.

According to the above embodiment, the protection net 50 has a thin discoid shape, and the entire surfaces thereof including the first surface 81 and the second surface 82 are flat. Further, the thickness of the mesh section 52 is approximately half the thickness of the peripheral edge section 51. Thus, it is possible to reduce the suction resistance without increasing the size in the axial direction of the turbomolecular pump 1. As illustrated in FIG. 1, disposing the protection net 50 with the recessed side of the mesh section 52 facing the rotor blades 6 enables the separation distance between the protection net 50 and the rotor blades 6 to be larger than that when the protection net 50 is disposed to face the opposite side. However, when the thickness of the protection net 50 is small, specifically, approximately 250 μm, the deformation amount of the protection net 50 is large relative to the thickness of the protection net 50, and there is thus little practical difference. Next, a method for manufacturing the protection net 50 will be described.

(Method for Manufacturing Protection Net)

FIGS. 3(A) to 3(D) and 4(A) to 4(C) illustrate an embodiment of a method for manufacturing the protection net 50. As illustrated in FIG. 3(A), a protection net forming member 50*a*, for example, SUS having a thickness equal to the thickness of the peripheral edge section 51 to be formed is prepared and cleaned. The protection net forming member 50*a* is a circular plate-like member. As illustrated in FIG. 3(B), photoresists 66 and 67 are respectively applied to both front and back surfaces, specifically, the first surface 81 and the second surface 82 of the protection net forming member 50*a*. The photoresists 66 and 67 may be positive photoresists, or may also be negative photoresists. In this case, the positive photoresists 66 and 67 are described.

As illustrated in FIG. 3(C), a mask 61 is arranged on the first surface 81 of the protection net forming member 50*a*, and a mask 71 is arranged on the second surface 82 thereof. Then, light is applied to the masks 61 and 71 to expose the photoresists 66 and 67 to the light. The mask 61 has a circular shape whose diameter is equal to the diameter of the outer peripheral surface of the peripheral edge section 51 of the protection net 50 (that is, the mask 61 has an outer periphery that is the same as the outer periphery of the peripheral edge section 51). Openings 62 corresponding to the through holes 55 of the mesh section 52 are formed on the mask 61. In other words, the mask 61 has a portion corresponding to the peripheral edge section 51 and a portion corresponding to the mesh section excepting the through holes 55. The mask 71 has a circular shape whose diameter is equal to the diameter of the outer peripheral surface of the peripheral edge section 51 of the protection net 50 (that is, the mask 71 has an outer periphery that is the same as the outer periphery of the peripheral edge section 51). An opening 72 corresponding to the mesh section 52 is formed on the mask 71. The opening 72 is formed concentrically with the mask 61. In other words, the mask 61 has only a portion corresponding to the peripheral edge section 51. As illustrated in FIG. 3(D), the photoresists 66 and 67 are developed. Openings 66*a* corresponding to the through holes 55 of the mesh section 52 are formed on the photoresist 66. An opening 67*a* corresponding to the mesh section 52 is formed on the photoresist 67.

As illustrated in FIG. 4(A), the masks 61 and 71 are peeled off. As illustrated in FIG. 4(B), the protection net forming member 50*a* is etched with an etching solution from both the front and back surfaces thereof. The protection net forming member 50*a* is etched from the first surface 81 with the etching solution penetrating through the openings 66*a* of the photoresist 66. Further, the protection net forming member 50*a* is etched from the second surface 82 with the etching solution penetrating through the opening 67*a* of the photoresist 67. The protection net forming member 50*a* is etched with the etching solution penetrating through the opening 67*a* of the photoresist 67 in such a manner that a recess that is concentric with the outer periphery of the peripheral edge section 51 is formed in a region corresponding to the mesh section 52.

An etching rate of etching the protection net forming member 50*a* from the front surface and an etching rate of etching the protection member 50*a* from the back surface are equal. Thus, at the point when the thickness of the protection net forming member 50*a* becomes half the original thickness thereof, the etching solution penetrating through the openings 66*a* of the photoresist 66 passes through the thickness of the protection net forming member 50*a*, thereby forming the through holes 55 of the mesh section 52. The etching is finished at this point. Then, as illustrated in FIG. 4(C), the photoresists 66 and 67 are peeled off. Then, the through holes 56 are formed on the peripheral edge section 51. Accordingly, the protection net 50 which includes the peripheral edge section 51 and the mesh section 52 which is formed on the inner side of the peripheral edge section 51, has the plurality of through holes 55, and has a thickness that is half the thickness of the peripheral edge section 51, the peripheral edge section 51 and the mesh section 52 being integrally formed, is formed. The above-described method for manufacturing the protection net in the first embodiment includes a preparing step of preparing the circular plate-like member, and a forming step of forming the peripheral edge section having a predetermined width on the outer peripheral part of the plate-like member by etching and forming the recessed mesh section on the inner side of the peripheral edge section by etching, the mesh section having a thickness that is equal to or less than half the thickness of the peripheral edge section and having the plurality of through holes. In the forming step, the circular recess is formed on the inner side of the peripheral edge section by etching from the first surface of the plate-like member, and the plurality of through holes which penetrate the plate-like member in the thickness direction thereof are formed within the circular recess by etching from the second surface of the plate-like member.

(Modification)

Figure 5:
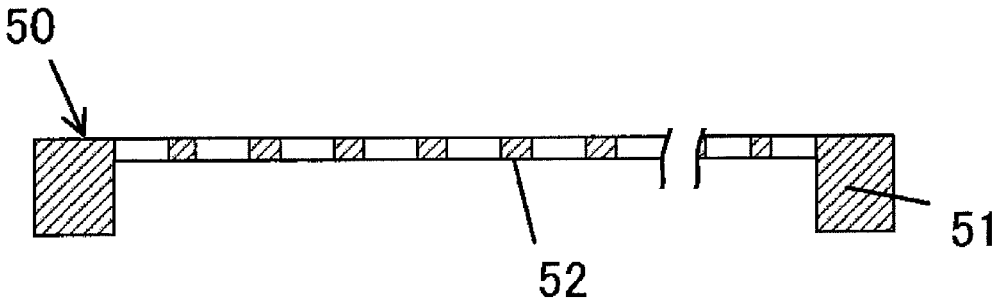
FIG. 5 is a cross-sectional view showing a modification of the vacuum pump protection net.

In the step of FIG. 4(B), the etching is continuously performed even after the etching solution penetrating through the openings 66*a* of the photoresist 66 has passed through the thickness of the protection net forming member 50*a*. Accordingly, the region corresponding to the mesh section 52 in the protection net forming member 50*a* is further etched and thinned with the etching solution penetrating through the opening 67*a* of the photoresist 67. FIG. 5 illustrates a protection net 50 which includes the mesh section 52 whose thickness is made thinner than half the thickness of the peripheral edge section 51 in this manner. As described above, the thickness of the mesh section 52 of the protection net 50 may be any thickness that is equal to or less than half the thickness of the peripheral edge section 51. The etching rate of the etching solution is isotropic. Therefore, in order to increase the etching depth, there is a need to allow for an increase in the width of the through holes 55 corresponding to the increase of the etching depth.

In the above embodiment, the protection net 50 includes the mesh section 52 which is entirely flat. Thus, the thickness of the entire protection net 50 is made thin, and it is therefore possible to reduce the size of the vacuum pump. Further, the thickness of the mesh section 52 is equal to or less than half the thickness of the peripheral edge section 51. Thus, it is possible to reduce the suction resistance against gas passing through the through holes 55 of the mesh section 52.

Second Embodiment

Figure 6:
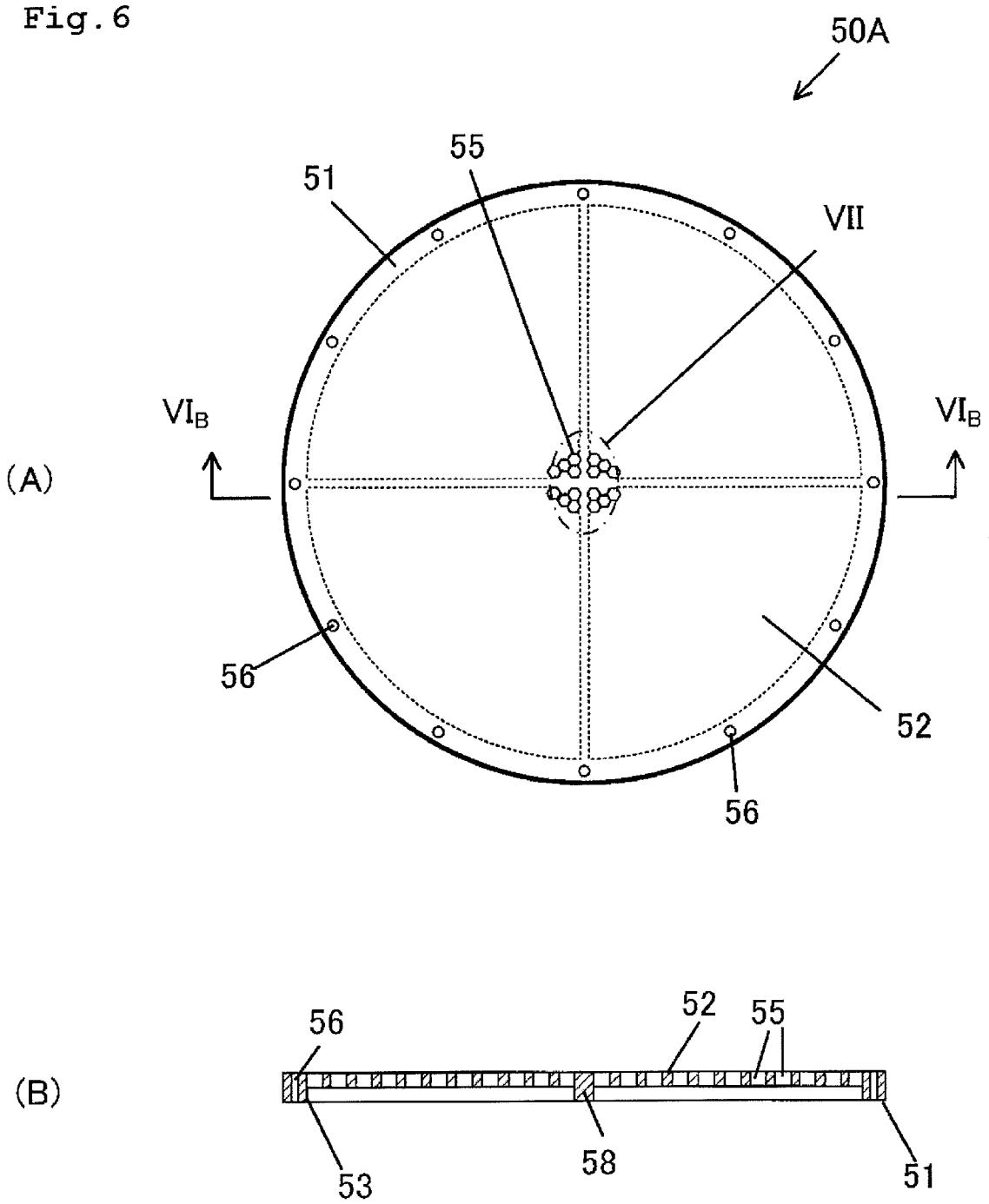
Figure 7:
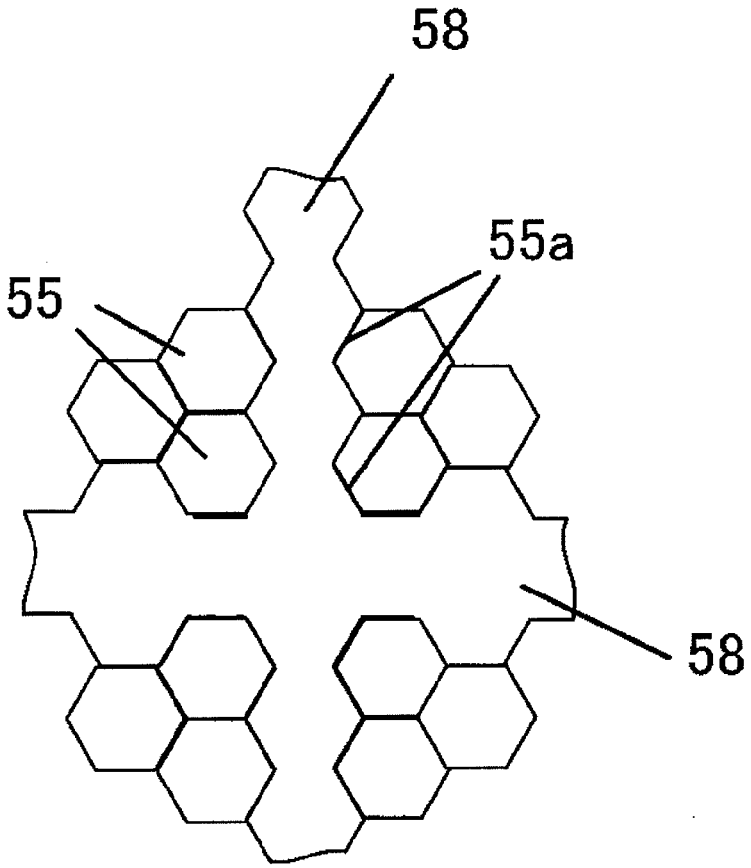
FIG. 7 is an enlarged view of region VII in FIG. 6(A).
Figure 8:
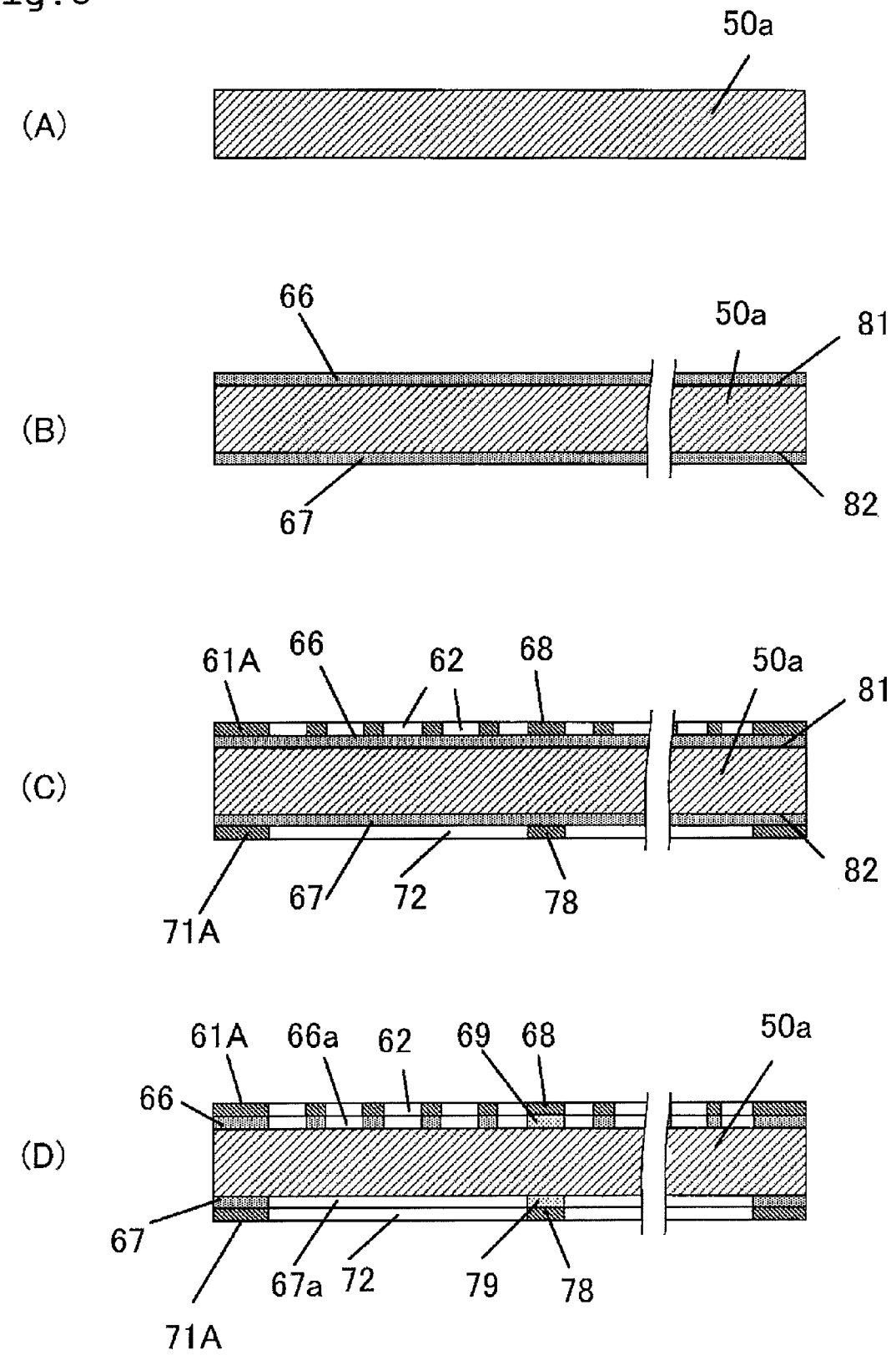
FIGS. 8(A) to 8(D) are diagrams for illustrating an embodiment of a method for manufacturing the vacuum pump protection net of the second embodiment.
Figure 9:
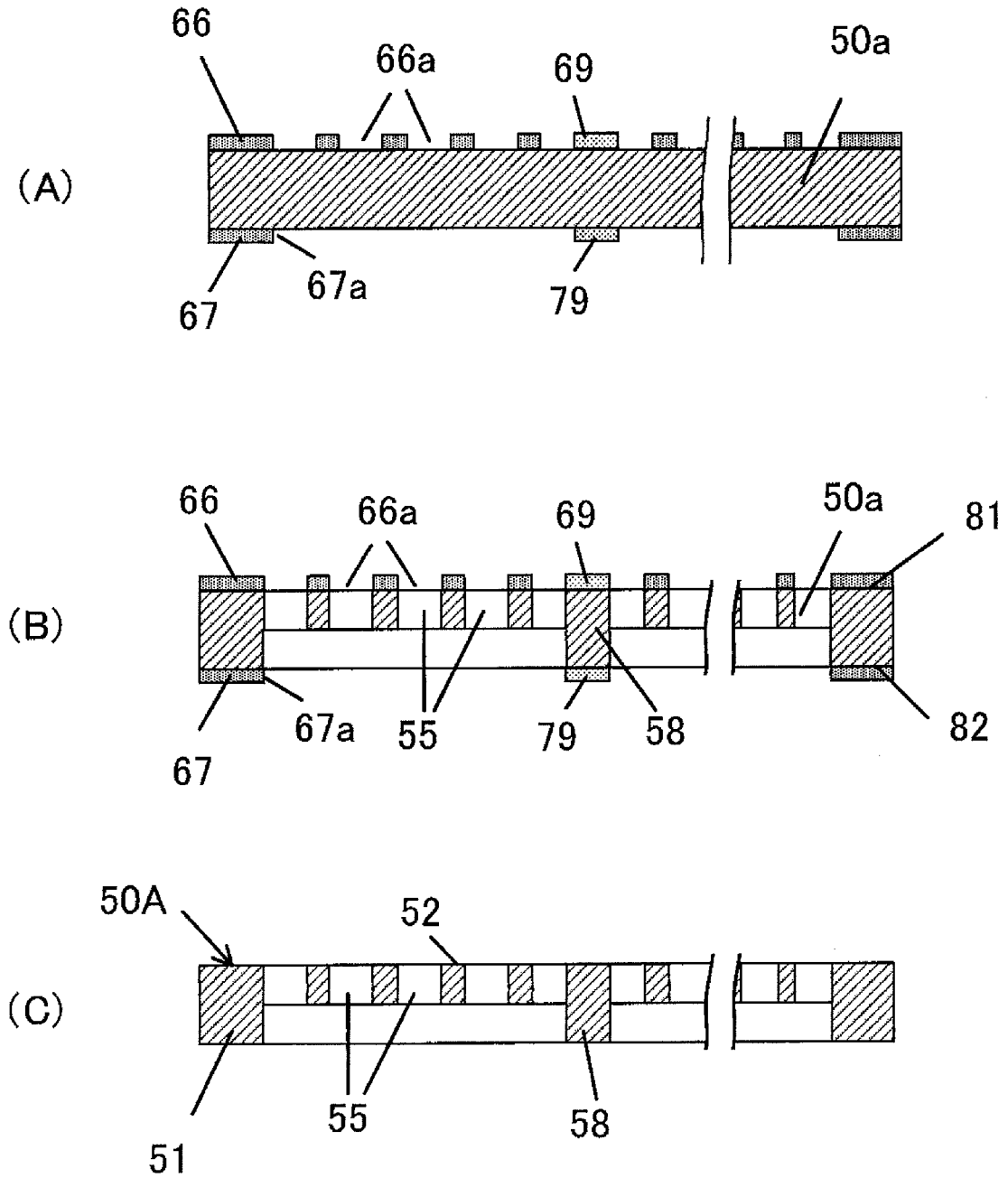
FIGS. 9(A) to 9(C) are diagrams for illustrating steps following the steps of FIGS. 8(A) to 8(D).

A second embodiment of the present invention will be described with reference to FIGS. 6(A) to 10. FIG. 6(A) is a plan view of a vacuum pump protection net according to the second embodiment of the present invention. FIG. 6(B) is a cross-sectional view taken along line VIB-VIB in FIG. 6(A). FIG. 7 is an enlarged view of region VII in FIG. 6(A). A protection net 50A of the second embodiment differs from the protection net 50 of the first embodiment in that a reinforcement rib 58 is disposed on a mesh section 52. Hereinbelow, the difference between the second embodiment and the first embodiment will be mainly described. Thus, description of similar points to the first embodiment will not be given by applying identical reference numerals to the corresponding members.

The reinforcement rib 58 is formed in a cross shape passing through the center of the mesh section 52, and integrally formed with a peripheral edge section 51 and the mesh section 52 using, for example, SUS. A first surface of the reinforcement rib 58 is located on the same plane as a first surface 81 of the peripheral edge section 51, and a second surface of the reinforcement rib 58 is located on the same plane as a second surface 82 of the peripheral edge section 51. In other words, the height (thickness) of the reinforcement rib 58 is equal to the thickness of the peripheral edge section 51 of the protection net 50A. The reinforcement rib 58 is integrated with the mesh section 52 on the first surface 81. The reinforcement rib 58 increases the strength against, for example, twist of the mesh section 52. In particular, the reinforcement rib 58 is preferably applied to the protection net 50 having the thin mesh section 52 illustrated in FIG. 5.

As illustrated in FIG. 7, the reinforcement rib 58 extends along side edges 55*a* of through holes 55 of the mesh section 52, the through holes 55 being adjacent to the reinforcement rib 58. The through holes 55 adjacent to the reinforcement rib 58 also have the same shape as through holes 55 in the other region, that is, a regular hexagonal shape. In other words, both side surfaces of the reinforcement rib 58 are located on the same plane as the side edges 55*a* of the adjacent through holes 55, and formed in a shape having a wide portion and a narrow portion corresponding to the shape of the side edges 55*a* of the through holes 55. Thus, providing the reinforcement rib 58 does not change the shape of the through holes 55, and therefore does not deteriorate the performance of the protection net 50 for blocking a foreign substance. Although the through holes 55 are continuously formed throughout the entire mesh section 52 in the same manner as in the first embodiment, the through holes 55 are illustrated only within region VII for the convenience of illustration also in FIG. 6. Further, the reinforcement rib 58 is formed in the same manner as within region VII throughout the entire mesh section 52.

(Method for Manufacturing Protection Net of Second Embodiment)

An embodiment of a method for manufacturing the protection net 50A will be described with reference to FIGS. 8(A) to 8(D), 9(A) to 9(C), and 10. As illustrated in FIG. 8(A), a protection net forming member 50*a*, for example, SUS having a thickness equal to the thickness of the peripheral edge section 51 to be formed is prepared and cleaned. As illustrated in FIG. 8(B), photoresists 66 and 67 are respectively applied to both front and back surfaces, specifically, the first surface 81 and the second surface 82 of the protection net forming member 50*a*. The photoresists 66 and 67 may be positive photoresists, or may also be negative photoresists. In this case, the positive photoresists 66 and 67 are described.

As illustrated in FIG. 8(C), a mask 61A is arranged on the first surface 81 of the protection net forming member 50*a*, and a mask 71A is arranged on the second surface 82 thereof. Then, light is applied to the masks 61A and 71A to expose the photoresists 66 and 67 to the light. Openings 62 corresponding to the through holes 55 of the mesh section 52 are formed on the mask 61A. Further, a reinforcement rib forming mask section 68 for forming the reinforcement rib 58 is formed on the mask 61A. An opening 72 corresponding to the mesh section 52 is formed on the mask 71. Further, a reinforcement rib forming mask section 78 for forming the reinforcement rib 58 is formed on the mask 71A.

Figure 10:
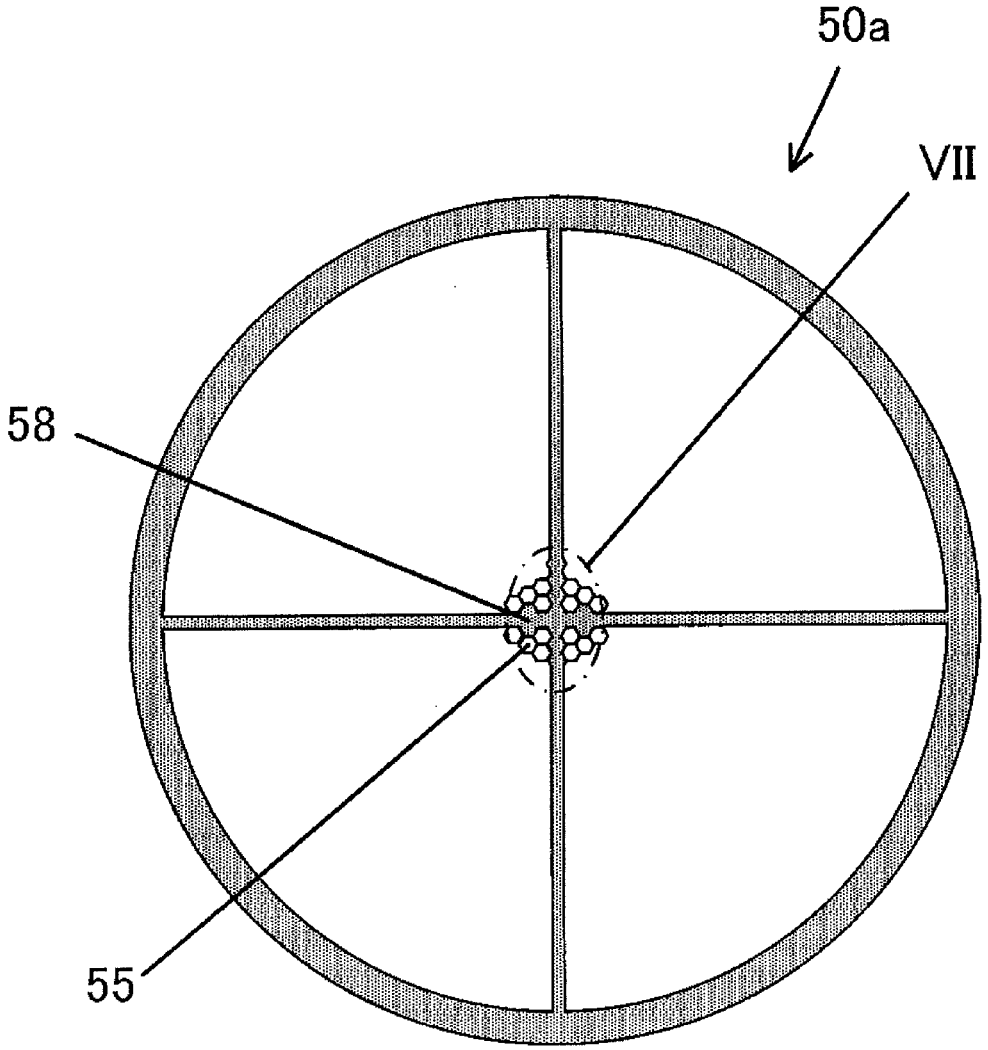
FIG. 10 is a diagram for illustrating a method for forming a reinforcement rib.

FIG. 10 is a plan view of the mask 61A. A mask section of the mask 61A is formed on the entire region of the protection net forming member 50*a* excepting the through holes 55, that is, formed on a region corresponding to the peripheral edge section 51, a region corresponding to the reinforcement rib 58, and a region of the mesh section 52 excepting a region corresponding to the through holes 55. Also in FIG. 10, the through holes 55 and the reinforcement rib forming mask section 68 are formed on the entire region outside region VII in the mesh section 52 in the same manner as within region VII. Although not illustrated in the plan view, the reinforcement rib forming mask section 78 of the mask 71A is formed in the same shape as the reinforcement rib forming mask section 68.

As illustrated in FIG. 8(D), the photoresists 66 and 67 are developed. Openings 66*a* corresponding to the through holes 55 of the mesh section 52 are formed on the photoresist 66. Further, a reinforcement rib forming resist section 69 corresponding to the reinforcement rib forming mask section 68 is formed on the photoresist 66. An opening 67*a* corresponding to the mesh section 52 is formed on the photoresist 67. Further, a reinforcement rib forming resist section 79 corresponding to the reinforcement rib forming mask section 78 is formed on the photoresist 67.

As illustrated in FIG. 9(A), the masks 61A and 71A are peeled off. As illustrated in FIG. 9(B), the protection net forming member 50*a* is etched with an etching solution from both the front and back surfaces thereof. The protection net forming member 50*a* is etched from the first surface 81 with the etching solution penetrating through the openings 66*a* of the photoresist 66. Further, the protection net forming member 50*a* is etched from the second surface 82 with the etching solution penetrating through the opening 67*a* of the photoresist 67.

At the point when the thickness of the protection net forming member 50*a* becomes half the original thickness thereof by being etched with the etching solution penetrating through the opening 67*a* of the photoresist 67, the etching solution penetrating through the openings 66*a* of the photoresist 66 passes through the thickness of the protection net forming member 50*a*, thereby forming the through holes 55 of the mesh section 52. Since the reinforcement rib forming resist sections 69 and 79 are respectively formed on the photoresists 66 and 67, the reinforcement rib 58 is formed on the protection net forming member 50*a*. That is, the protection net 50A in which the peripheral edge section 51, the mesh section 52, and the reinforcement rib 58 are integrally formed is formed.

The etching is finished at this point. Then, as illustrated in FIG. 9(C), the photoresists 66 and 67 are peeled off. Accordingly, the protection net 50A which includes the peripheral edge section 51, the mesh section 52 which is formed on the inner side of the peripheral edge section 51, has the plurality of through holes 55, and has a thickness that is half the thickness of the peripheral edge section 51, and the reinforcement rib 58, the peripheral edge section 51, the mesh section 52, and the reinforcement rib 58 being integrally formed, is formed. Also in the protection net 50A of the second embodiment, the mesh section 52 may be formed to have a thickness thinner than half the thickness of the peripheral edge section 51 as illustrated in FIG. 5.

Also in the second embodiment, the protection net 50A includes the mesh section 52 which is entirely flat. Thus, the thickness of the entire protection net 50A is made thin, and it is therefore possible to reduce the size of the vacuum pump. Further, the thickness of the mesh section 52 is equal to or less than half the thickness of the peripheral edge section 51. Thus, it is possible to reduce the suction resistance against gas passing through the through holes 55 of the mesh section 52. Further, the reinforcement rib 58 which reinforces the mesh section 52 is integrally formed. Thus, it is possible to increase the strength.

In each of the above embodiments, each of the through holes 55 formed on the mesh section 52 has a regular hexagonal shape in plan view. However, the shape of the through holes 55 is not limited thereto, and may be a circular shape or other polygonal shapes.

The through holes 55 of the mesh section 52 may be formed not by etching, but by pressing or machining. The attachment through holes 56 of the peripheral edge section 51 may be formed by the same photolithography when forming the mesh section 52, or may also be formed by machining.

The reinforcement rib 58 having a cross shape has been described as an example. However, many ribs radially extending from the center of the mesh section 52 toward the peripheral edge section may be provided. Further, a circumferential connection rib for coupling the radial ribs to each other may be provided.

In the above embodiments, the turbo-molecular pump which includes the turbine blade exhaust unit and the screw groove exhaust unit has been described as an example. However, the present invention can also be applied to a full blade type turbo-molecular pump having no screw groove exhaust unit or a turbo-molecular pump in which a controller for controlling the motor 35, the magnetic bearings 31, 32, and the displacement sensors 33*a* to 33*c*, and the like is integrally attached to the pump container 11. Further, the present invention can be applied not only to turbo-molecular pumps, but also to vacuum pumps having a bearing structure similar to the bearing structure of the turbo-molecular pumps, for example, a drag pump.

In addition, the present invention can be applied with various modifications within the scope of the invention. In short, it is only required that the peripheral edge section and the flat mesh section formed on the inner side of the peripheral edge section be integrally formed of the same material, the thickness of the mesh section be equal to or less than half the thickness of the peripheral edge section, the first surface of the mesh section be located on the same plane as the first surface of the peripheral edge section, the second surface of the mesh section be recessed from the second surface of the peripheral edge section.

The invention claimed is:

1. A method for manufacturing a vacuum pump protection net, the vacuum pump protection net comprising a peripheral edge section and a mesh section integrally formed with the peripheral edge section on an inner side of the peripheral edge section, the mesh section having a thickness equal to or less than half a thickness of the peripheral edge section and where a plurality of through holes are formed, the method comprising the steps of:

applying photoresists to both first and second surfaces of a plate-like member;

arranging a mask on the first surface of the plate-like member, the mask having the same outer periphery as an outer periphery of the peripheral edge section and having openings corresponding to the through holes;

arranging a mask on the second surface of the plate-like member, the mask having the same outer periphery as the outer periphery of the peripheral edge section and having an opening corresponding to the entire mesh section;

etching the plate-like member from both the first surface of the plate-like member and the second surface of the plate-like member at the same time, forming a plurality of the through holes by the etching on the first surface of the plate-like member;

forming a recess on the inner side of the peripheral edge section by the etching on the second surface of the plate-like member;

forming a portion that is not etched by each of the etchings as the peripheral edge section; and developing the photoresists.

2. The manufacturing method according to claim 1, wherein an etching rate of etching the plate-like member from the first surface of the plate-like member and an etching rate of etching the plate-like member from the second surface of the plate-like member are equal.

3. The manufacturing method according to claim 1, wherein the mask on the second surface of the plate-like member has the opening corresponding to the entire mesh section and has a mask section corresponding to the reinforcement rib; and a portion that is not etched by each of the etchings is formed as the peripheral edge section and the reinforcement rib.

* * * * *